United States Patent [19]

Bonta et al.

[11] 4,285,491

[45] Aug. 25, 1981

[54] SECTIONAL HOT TOP

[75] Inventors: Anthony R. Bonta, Hobart; Charles J. Gasche, Portage, both of Ind.

[73] Assignee: United States Steel Corporation, Pittsburgh, Pa.

[21] Appl. No.: 103,799

[22] Filed: Dec. 14, 1979

Related U.S. Application Data

[63] Continuation-in-part of Ser. No. 944,506, Sep. 21, 1978, abandoned.

[51] Int. Cl.[3] ..... B22D 7/10

[52] U.S. Cl. ..... 249/102; 249/197

[58] Field of Search ..... 249/102, 106, 197–201; 46/25, 26; 52/590, 593, 595

[56] References Cited

U.S. PATENT DOCUMENTS

| | | | |
|---|---|---|---|
| 1,804,204 | 5/1931 | Charman et al. | 249/201 |
| 1,804,206 | 5/1931 | Charman et al. | 249/201 |
| 1,892,464 | 12/1932 | Haws | 249/198 |

FOREIGN PATENT DOCUMENTS

| | | | |
|---|---|---|---|
| 538793 | 6/1955 | Belgium | 52/593 |
| 584464 | 10/1958 | Italy | 52/593 |

*Primary Examiner*—Robert D. Baldwin

*Attorney, Agent, or Firm*—William F. Riesmeyer, III

[57] ABSTRACT

A hot top for an ingot mold has a plurality of sections mateable along adjoining edges. The sections include two diametrically opposed lift sections engageable by a crane for transporting the hot top and an intermediate section fitting between corresponding ends of the lift sections. A tongue and groove joint is provided along the adjoining edges of the sections to make them readily detachable and facilitate interchange of sections of different lengths. The joint is tapered in the longitudinal direction from top to bottom of the edges so as to transmit an upward force to the intermediate sections when the lift sections are raised thus preventing separation of the sections when the hot top is transported.

5 Claims, 3 Drawing Figures

SECTIONAL HOT TOP

This is a continuation-in-part of our copending application Ser. No. 944,506 filed Sept. 21, 1978, now abandoned.

BACKGROUND OF THE INVENTION

This invention relates to hot tops for forming a sinkhead on cast metal ingots, and particularly to hot tops made up of a plurality of sections.

A refractory hot top is shown in U.S. Pat. No. 1,892,464 which has interlocking tongue and groove joints. This hot top must be assembled directly on the ingot mold which may prove hazardous since a person must step out onto the molds to install the hot top and put the sections together. In addition, this is quite time consuming.

Another type of sectional hot top is shown in U.S. Pat. No. 1,804,206. The metal sections of this hot top are fastened by screws. Thus, the sections are not readily detachable.

It is a primary object of this invention to provide a hot top comprised of a plurality of readily detachable sections which may be assembled at a location remote from the ingot mold and transported thereto by conventional means.

SUMMARY OF THE INVENTION

According to this invention, a hot top for an ingot mold has a plurality of sections mateable along adjoining edges. The sections include at least two diametrically opposed lift sections engageable by a crane for transporting the hot top and an intermediate section fitting between each of the corresponding ends of the lift sections. A tongue and groove joint is provided along the adjoining edges of the sections to make them readily detachable and facilitate interchange of sections of different lengths to change the size of the hot top. The joint on the lift section is tapered from a larger cross section at the bottom to a smaller cross section at the top when the edges of the lift section have a tongue, and are tapered from a smaller cross section at the bottom to a larger cross section at the top when the edges of the lift section have a groove. The tapered joint serves to transmit an upward force from the lift sections to the intermediate section so as to prevent separation of the sections when the hot top is transported. Preferably, the tongues are also tapered from a larger lateral dimension at their furthest projection from the edge of the section to a smaller dimension adjoining the edge, with the groove being mateable with the tongue so as to also prevent lateral separation of the hot top sections.

DESCRIPTION OF THE PREFERRED EMBODIMENT

Figure 1:
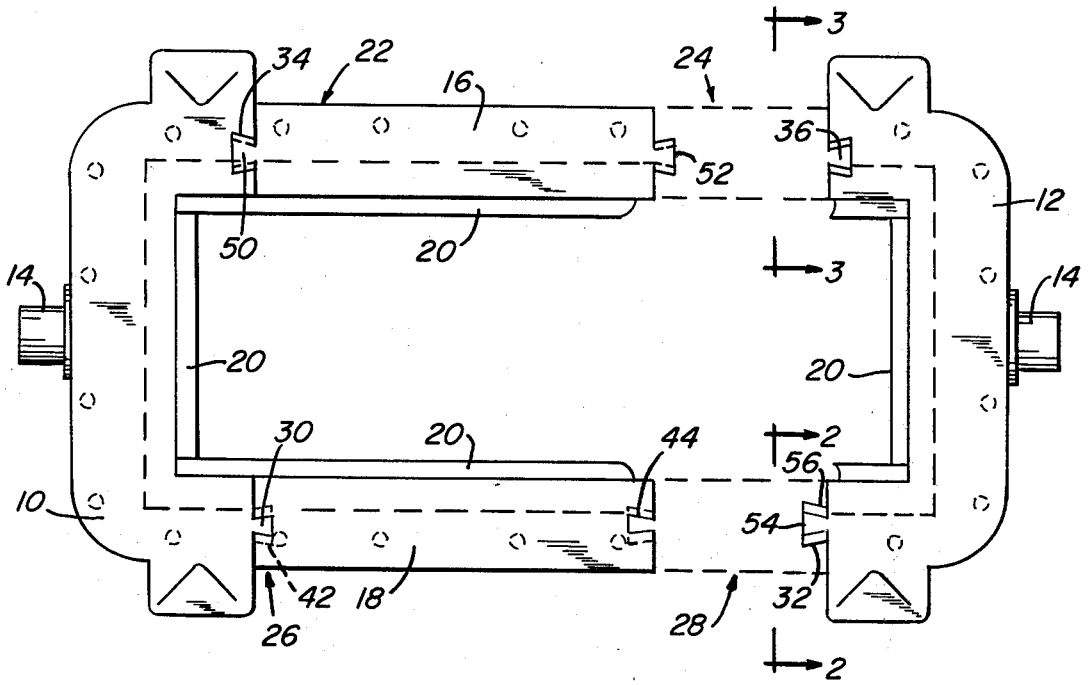
FIG. 1 is a top view of the hot top of this invention.

Referring to FIG. 1, the hot top of this invention has a plurality of sections including diametrically opposed lift sections 10, 12 each with lug 14 engageable by a conventional crane attachment. Intermediate sections 16, 18 fit between the lift sections. The hot top sections may be composed of a refractory material, or as illustrated of metal with refractory boards 20 secured to the inner faces of the sections.

Figure 2:
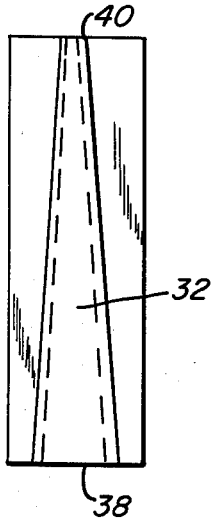
FIG. 2 is a view taken at 2—2 of FIG. 1.
Figure 3:
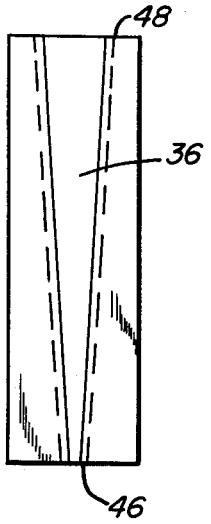
FIG. 3 is a view taken at 3—3 of FIG. 1.

Means is provided for connecting the sections together and includes tongue and groove joints 22, 24, 26, 28. As shown in joints 26, 28 the lifting sections may have tongues 30, 32 or as shown in joints 22, 24 grooves 34, 36. Tongues 30, 32 on the lifting sections are tapered from a larger cross section at the bottom 38 (FIG. 2) of the edge to a smaller cross section at the top 40. The grooves 42, 44 are similarly tapered and mateable with the tongues 30, 32. Grooves 34, 36 on the lifting sections are tapered from a smaller cross section at the bottom 46 (FIG. 3) to a larger cross section at the top 48 (FIG. 3) of the edge. The tongues 50, 52 are similarly tapered and are mateable with the grooves 34, 36. The tongues 30, 32, 50, 52 are also tapered from a larger lateral dimension as illustrated at 54 on tongue 32 at their furthest projection from the edges of the section on which they are located than where they join the edge itself as at 56. When the hot top sections are made of metal in cast shapes, the tongue and groove portions may be cast in place and do not require machining since close tolerances are not necessary.

It will be apparent from FIG. 1 that when the hot top is composed of end sections 10, 12 which as shown have intersecting side portions forming the corners of the hot top that the straight side sections 16, 18 may be interchanged with other straight side sections of different length to facilitate making different size hot tops using the same end sections. Each straight side section may further be comprised of straight subsections having means adjacent one of the lift sections as above described for transmitting an upward force to the adjacent subsection.

We claim:

1. In a hot top for an ingot mold, said hot top comprising a plurality of sections mateable along adjoining substantially vertical edges, said sections including a pair of diametrically opposed lift sections with means engageable by a crane for transporting said hot top and an intermediate section fitting between each of the corresponding ends of the lift sections, and means for connecting said lift sections and intermediate sections together, the improvement in said hot top in which:

said connecting means comprises a tongue and groove joint extending longitudinally along the adjoining edges of said lift sections and intermediate sections so that said sections are readily detachable and may be interchanged with sections of various lengths to change the size of said hot top, said joints being tapered in the longitudinal direction thereof so as to transmit an upward force to the intermediate sections when the lift sections are raised and thus prevent separation of the sections during transport of the hot top.

2. The apparatus of claim 1 wherein the tongue of each of said joints is also tapered from a larger transverse dimension at the edge thereof projecting furthest from the edge of the hot top sections to a smaller dimension at the edge thereof adjoining the edge of the hot top section, and the groove of said joints is of mateable cross section with said tongues so as to prevent lateral separation of the hot top sections.

3. The apparatus of claim 1 wherein said hot top comprises a pair of end sections having intersecting side portions forming the corners of said hot top, and a straight intermediate section fitting between each of the corresponding side portions of said end sections, said intermediate sections being interchangeable with other intermediate sections of different length so as to facilitate making different size hot tops using the same end sections.

4. The apparatus of claim 1 wherein said joint comprises a tongue on said lift section, said tongue being tapered from a larger cross section at the bottom of said adjoining edges to a smaller cross section at the top thereof, and a groove on said intermediate section mateable with said tongue.

5. The apparatus of claim 1 wherein said joint comprises a groove on said lift section, said groove being tapered from a smaller cross section at the bottom of said adjoining edges to a larger cross section at the top thereof, and a tongue on said intermediate section mateable with said groove.

* * * * *